US006748982B2

(12) United States Patent
Goggin

(10) Patent No.: US 6,748,982 B2
(45) Date of Patent: Jun. 15, 2004

(54) INTEGRATED FUEL DELIVERY AND VAPOR RECOVERY SYSTEM FOR A FUEL DISPENSER

(75) Inventor: William Goggin, Garrett, IN (US)

(73) Assignee: Tokheim Holding B.V. (FR)

( * ) Notice: Subject to any disclaimer, the term of this patent is extended or adjusted under 35 U.S.C. 154(b) by 68 days.

(21) Appl. No.: 10/008,056

(22) Filed: Nov. 13, 2001

(65) Prior Publication Data

US 2003/0089416 A1 May 15, 2003

(51) Int. Cl.[7] ..... B65B 1/04; B65B 3/04

(52) U.S. Cl. ..... 141/1; 141/285

(58) Field of Search ..... 141/1, 4–8, 59, 141/94, 104, 105, 107, 285, 302; 222/25–36; 137/614.04; 285/133.11, 134.1, 136.1, 138.1

(56) References Cited

U.S. PATENT DOCUMENTS

| | | | | | |
|---|---|---|---|---|---|
| 2,021,544 | A | | 11/1935 | Crown | 221/67 |
| 3,280,530 | A | | 10/1966 | Rothenbach | 52/731 |
| 3,670,764 | A | | 6/1972 | Tindal | |
| 3,981,335 | A | * | 9/1976 | Deters | 141/46 |
| 3,995,769 | A | | 12/1976 | Kuwabara et al. | |
| D244,563 | S | | 5/1977 | Taylor et al. | |
| 4,440,195 | A | | 4/1984 | van Dongeren | |
| 4,576,312 | A | | 3/1986 | Swick, Jr. | |
| 4,827,960 | A | * | 5/1989 | Nitzberg et al. | 137/68.15 |
| 4,880,026 | A | | 11/1989 | Ferre et al. | |
| 4,986,446 | A | | 1/1991 | Montgomery et al. | |
| 5,203,384 | A | * | 4/1993 | Hansen | 141/59 |
| 5,355,915 | A | * | 10/1994 | Payne | 141/83 |
| 5,407,300 | A | | 4/1995 | Guindon et al. | |
| 5,415,155 | A | | 5/1995 | Cohen et al. | |
| 5,615,706 | A | * | 4/1997 | Guertin | 137/614.04 |
| 5,634,503 | A | * | 6/1997 | Musil et al. | 141/232 |
| 5,868,175 | A | | 2/1999 | Duff et al. | |
| 6,039,080 | A | | 3/2000 | Beijaard et al. | |
| 6,039,123 | A | | 3/2000 | Webb | |
| 6,109,290 | A | | 8/2000 | Sabatinelli | |
| 6,223,788 | B1 | * | 5/2001 | Taylor | 141/9 |

* cited by examiner

*Primary Examiner*—Timothy L. Maust
(74) *Attorney, Agent, or Firm*—Randall J. Knuth

(57) ABSTRACT

A method and apparatus for an integrated vapor recovery and fuel delivery system for a fuel dispenser. The apparatus includes a fuel dispenser having a member constructed from extruded material connected to the fuel dispenser. The member has at least one fluid conduit located inside the member for transporting fluid. The member also has a vapor conduit located inside the member for transporting vapor.

4 Claims, 3 Drawing Sheets

INTEGRATED FUEL DELIVERY AND VAPOR RECOVERY SYSTEM FOR A FUEL DISPENSER

BACKGROUND OF THE INVENTION

1. Field of the Invention

The present invention relates to a method and apparatus for a fuel dispenser having an integrated vapor recovery and fuel delivery system made from an extruded material.

2. Description of the Related Art

Vapor recovery systems and fuel dispensers have been in existence for quite some time. The vapor recovery system is used to collect vapors before they are emitted into the atmosphere while a vehicle is completing a fueling operation. Currently, the fuel delivery system and the vapor recovery system are separate components within a fuel dispenser. For both the fuel delivery system and the vapor recovery system to fit within the fuel dispenser, the copper piping used to construct each of the systems must have many different pieces with different shapes and sizes for both systems to fit within the fuel dispenser. Each piece of copper piping is soldered together. With so many piping pieces for each system, construction and maintenance costs are high because of the large quantity of pieces involved and the large amount of soldering that is needed to keep the pieces connected. The present invention reduces these maintenance costs considerably.

SUMMARY OF THE INVENTION

The present invention, in one form thereof, is a fuel dispenser having an integrated fuel delivery and vapor recovery system. The fuel dispenser is connected with a member constructed from extruded material. The member has at least one conduit for dispensing fluid such as fuel. Also, the member has a conduit for transporting vapor.

The invention, in another form thereof, comprises a method of integrating fuel delivery with a vapor recovery system for a fuel dispenser. The method includes constructing a member from an extruded material. The extruded material is constructed to have at least one fluid conduit for transporting fluid. Also, the extruded material is constructed to have a vapor conduit for transporting vapor.

An advantage of the present invention is that by constructing an integrated fuel delivery and vapor recovery system, there are less parts involved and therefore, less maintenance. Also, there are less opportunities for leaks where the parts are soldered together.

Another advantage of the present invention is that extruded material is less expensive than the copper currently being used.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

The present invention is a fuel dispenser having an integrated fuel delivery and vapor recovery system.

Figure 1:
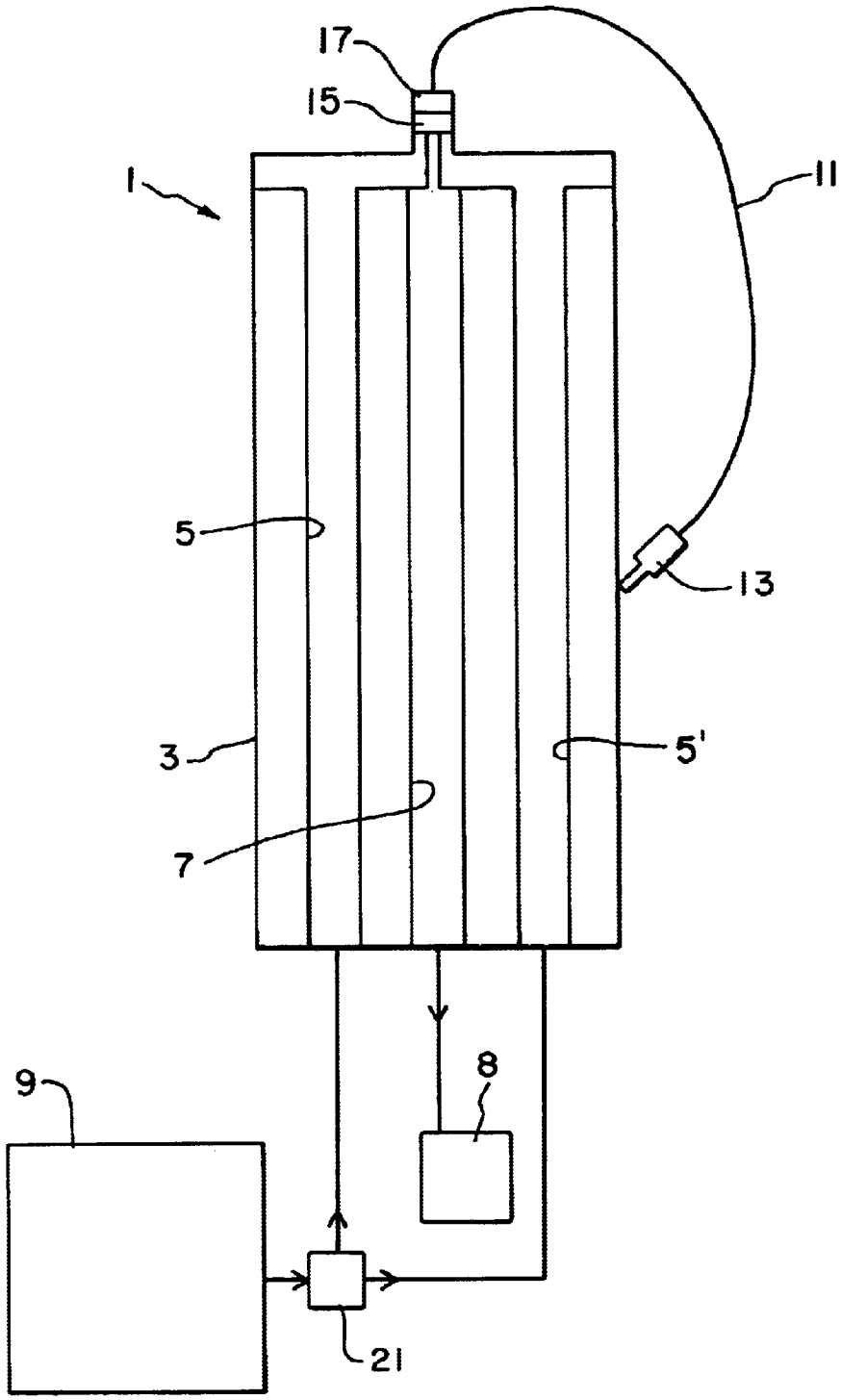
FIG. 1 is a diagrammatic view of one embodiment of the present invention.

Referring now to the drawings and particularly to FIG. 1, there is shown an embodiment of the present invention. A fuel dispenser 1 is connected with a member 3. Member 3 is constructed from an extruded material. Preferably, the extruded material is metal, but plastic or other types of material may be used.

Member 3 is connected to the side of fuel dispenser 1. Member 3 can be connected (as broadly used in this application) to other locations with fuel dispenser 1 or even be freestanding. Fuel dispenser 1 can be constructed with member 3 connected to fuel dispenser 1 or member 3 can be connected to fuel dispenser 1 at a later time by welding, soldering, using bolts, using clips, adhesives or other connecting means.

Figure 3:
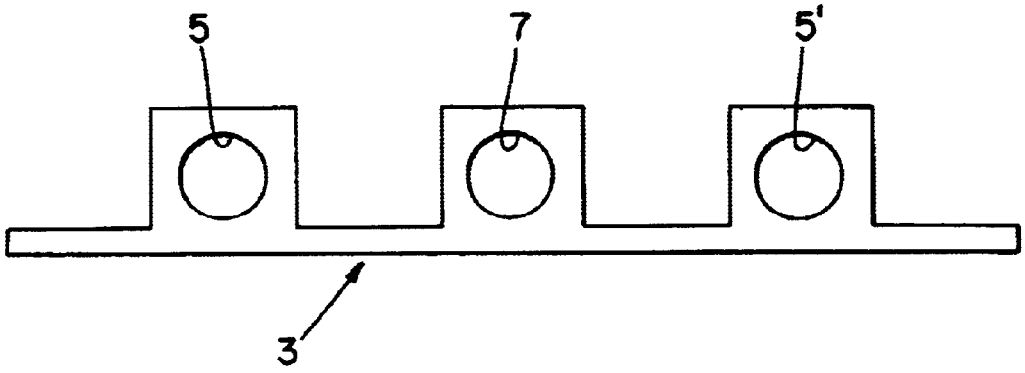
FIG. 3 is a sectional view of the member.

At least one fuel conduit 5 is constructed within member 3. Preferably, the fluid conduit is used as a fluid passageway for fuel such as gasoline, diesel fuel, and kerosene. Other fluids can be used as well. As shown in FIG. 3, fuel conduit 5 is circular shaped, however other shapes can be used. Fuel conduit 5 is connected at one end to a fuel pump 21 using a connecting means such as a pipe. Fuel pump 21 is connected to a fuel storage tank 9 using a connecting means to send fuel through fuel conduit 5.

Member 3 can be constructed to having two or more fuel conduits 5 and 5' for containing either one grade of fuel or different grades of fuel. Multiple fuel conduits 5 and 5' can be connected using a blend valve 15 to blend different transported fuels together to be dispensed from fuel dispenser 1. Once the fuel is blended together, the fuel can be distributed to one or more fuel dispensing hoses 11.

Also, fuel conduits 5 and 5' can be connected to at least one flow meter 17, such as an axial flow meter, to measure the volume of fuel dispensed from each of fuel conduits 5 and 5'. Flow meter 17 can be connected to either end of fuel conduits 5 and 5' and also can be connected to blending valve 15 to measure the volume of blended fuel being dispensed. Fuel conduits 5 and 5' connect at the end distal their connection with fuel pump 21, to a fuel dispensing hose 11. Fuel openings 5 and 5' can connect to fuel dispensing hose 11 or fuel conduits 5 and 5' can connect to the same fuel dispensing hose 11. Fuel dispensing hose 11 is connected to a nozzle 13 for dispensing fuel from fuel dispenser 1.

A vapor conduit 7 is constructed within member 3. Member 3 may have more than one vapor conduit 7. As shown in FIG. 3, vapor conduit 7 is circular shaped, but other shapes can be used. Vapor conduit 7 is used to collect vapors from a vehicle fuel tank (not shown) and/or emitted from fuel dispensed from fuel dispenser 1. At one end of vapor conduit 7 is a suction device 8, such as a pump, to create suction in vapor conduit 7. The side of vapor conduit 7 distal to the connection with suction device 8 connects to fuel dispensing hose 11 so vapor recovery can commence near nozzle 13. Fuel dispensing hose 11 is also connected to at least one of fuel conduits 5.

When fuel is dispensed from fuel dispenser 1 and pump 8 operates, vapor conduit 7 transports fuel vapor from about nozzle 13. Once the vapor is transported through vapor conduit 7, it is stored in a vapor recovery tank (not shown). Other ways of connecting vapor conduit 7 to fuel dispenser 1 to collect vapor may be used.

Different combinations of fluid conduits 5 and vapor conduit 7 can be used within the structure of member 3. For example, member 3 could have an equal number of fluid conduits and vapor conduits. FIG. 3 shows an example of member 3 with two fuel conduits 5 and 5' and one vapor conduit 7. The number of fuel conduits and vapor conduits depends upon the throughput desired for both the fueling options and the volume of suction for the vapor pump.

Figure 2:
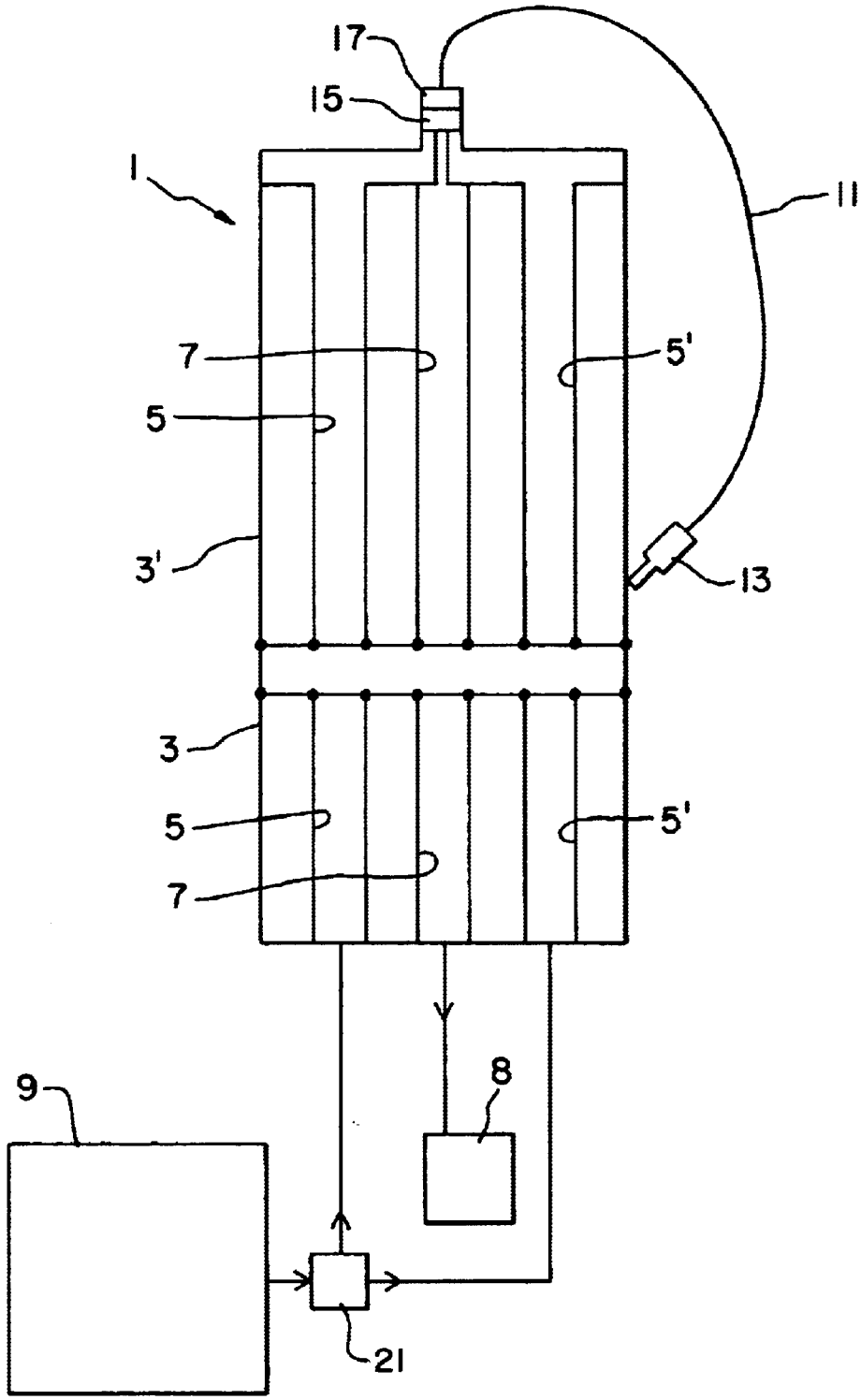
FIG. 2 is a diagrammatic view of one embodiment of the present invention.

As shown in FIG. 2, more than one member 3 can be used serially with fuel dispenser 1. Member 3 can be connected to fuel pump 21 which is connected to fuel storage tank 9. Fuel pump 21 pumps the fuel from storage tank 9 through the fuel conduits 5 and 5' and further, to be described, to and through dispensing hose 11 to nozzle 13. The distal end of member 3 can be connected to an adapter 19.

Adapter 19 can contain blend valves, flow meters, a continuation of the fuel conduits 5 and 5' and vapor conduit 7 as well as contain other types of devices. An example of adapter 19 containing a continuation is that members 3 and 3' can be connected using adapter 19 to connect directly to one another wherein fuel conduits 5 and 5' and vapor conduit 7 from each of the members 3 and 3' are in alignment for transporting fuel and vapor. The distal end of adapter 19 is connected to member 3'. The adapter 19 is connected to members 3 and 3' using connection means such as seals. Member 3' would further be connected to at least one fuel dispensing hose 11. This configuration of utilizing two serial members 3 allows easy placement and access to the valves, flow meters and/or other devices within adapter 19. Other configurations for fuel dispenser 1 using more than one member 3 are possible, such as parallel connections.

In another form of the present invention, a method of integrating a vapor recovery and fuel delivery system for a fuel dispenser is described.

The method begins with the step of constructing (30) the member from an extruded material.

Extrusion of materials, such as metal, are performed using an extruder like the kind available from Cincinnati Extrusion, Laxenburgerstr. 246, A-1239 Vienna, Austria. The material is placed in the extruder so that the extruding process can begin. The material can be a metal alloy, thermoplastic material as well as other types of materials may be used. Aluminum is a preferred material because of the variety of configurations that can be made with aluminum, as well as, the good physical properties of aluminum.

A die is placed in the extruder to create the shape of the extruded material. A hollow-shaped die would be used in the present invention to create a circular conduit.

The material to be placed in the extruder can be in a liquid form, pellet form or any type of form that meet the requirements of that particular extruder. The material is heated inside the extruder and then the heated material is pushed through the die and cooled immediately upon exiting the die. The cooling of the extruded material may be typically completed using blowing air, but other cooling methods can be used as well.

The member is constructed to have at least one fuel conduit within its structure. The fuel conduit is typically one to three inches in diameter, but larger or smaller conduits could be used.

The member is constructed to have a vapor conduit within its structure. The member may have more than one vapor conduit. The vapor conduit is typically one to three inches in diameter but other sizes of conduits could be used. As previously discussed, the vapor conduit is used to collect vapors emitted from vehicle fuel tanks or fuel dispensed from the fuel dispenser. Different combinations and configurations of fuel conduits and vapor conduits can be constructed within the structure of the member. The member could have an equal number of fluid conduits and vapor conduits within its structure.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of integrating a vapor recovery and fuel delivery system for a fuel dispenser, said method comprising:

extruding a material so as to thereby form a member having at least one fluid conduit for dispensing fluid and having a vapor conduit for collecting vapor, each said fluid conduit and said vapor conduit being integrally formed as portions of said member via said extruding.

2. The method of integrating a vapor recovery and fuel delivery system in claim 1, wherein said extruded material is a metal.

3. The method of integrating a vapor recovery and fuel delivery system in claim 1, comprising the step of transporting fuel through said at least one fluid conduit.

4. The method of integrating a vapor recovery and fuel delivery system in claim 1, comprising the step of transporting fuel vapor through said vapor conduit.

* * * * *